US008764157B2

(12) United States Patent
Ozawa

(10) Patent No.: US 8,764,157 B2
(45) Date of Patent: Jul. 1, 2014

(54) INK JET RECORDING DEVICE, WASTE INK TRAY, AND WASTE INK COLLECTING METHOD USING WASTE INK TRAY

(71) Applicant: Kyocera Document Solutions Inc., Osaka (JP)

(72) Inventor: Noriaki Ozawa, Osaka (JP)

(73) Assignee: KYOCERA Document Solutions Inc., Kyoto (JP)

( * ) Notice: Subject to any disclaimer, the term of this patent is extended or adjusted under 35 U.S.C. 154(b) by 0 days.

(21) Appl. No.: 13/952,486

(22) Filed: Jul. 26, 2013

(65) Prior Publication Data

US 2014/0028753 A1 Jan. 30, 2014

(30) Foreign Application Priority Data

Jul. 27, 2012 (JP) ..... 2012-167388

(51) Int. Cl.
*B41J 2/20* (2006.01)

(52) U.S. Cl.
USPC ..... 347/19; 347/36; 347/90

(58) Field of Classification Search
USPC ..... 347/19, 36, 45, 46, 89, 90
See application file for complete search history.

(56) References Cited

U.S. PATENT DOCUMENTS

2011/0034787 A1* 2/2011 Hagino et al. ..... 600/316

FOREIGN PATENT DOCUMENTS

JP 2009-000891 A 1/2009

* cited by examiner

*Primary Examiner* — Thinh Nguyen
(74) *Attorney, Agent, or Firm* — Studebaker & Brackett PC

(57) ABSTRACT

An inkjet recording device includes a recording head and a waste ink tray. The recording head is configured to eject droplets of ink. The waste ink tray is configured to receive the ink drained from the recording head. A surface of the waste ink tray, which receives the ink, is made of an antibacterial agent containing resin composition. A solubility of the antibacterial agent containing resin composition, which is measured by a predetermined measurement method, is 1.0 or higher and 3.0 or lower.

19 Claims, 6 Drawing Sheets

INK JET RECORDING DEVICE, WASTE INK TRAY, AND WASTE INK COLLECTING METHOD USING WASTE INK TRAY

INCORPORATION BY REFERENCE

The present application claims priority under 35 U.S.C. §119 to Japanese Patent Application No. 2012-167388, filed Jul. 27, 2012. The contents of this application are incorporated herein by reference in their entirety.

BACKGROUND

The present disclosure relates to inkjet recording devices, waste ink trays, and waste ink collecting methods using such a waste ink tray.

Some type of inkjet recording device includes a plurality of recording heads, a plurality of nozzle cap members, and a waste ink tray. The recording heads include nozzle surfaces on which ink ejection nozzles (nozzles) are formed. The nozzle cap members are provided correspondingly to the recording heads. The nozzle cap members can be disposed below the corresponding recording heads. The waste ink tray is movably disposed below the nozzle cap members. Ink drained from the nozzles is temporarily retained in the nozzle cap members. In particular, when ink ejection for obviation of nozzle clogging, which is generally called an ejection recovery process (purging), is performed at a recording (printing) start, a considerable amount of ink drained from the nozzles is temporarily retained in the nozzle cap members.

The waste ink tray receives the ink temporarily retained in the nozzle cap members and the ink overflowing from the nozzle cap members. The ink that the waste ink tray receives is sent by suction force by, for example, a pump or the like to a waste ink tank to be stored.

However, waste ink partially remaining in the waste ink tray may be decomposed by bacteria entering from the outside of the inkjet recording device. As a result, it begins to smell, or so forth. A glycol ether component contained in the waste ink remaining in the waste ink tray may cause degradation of members composing the waste ink tray. It is noted that the glycol ether component provides paper with wettability.

To tackle this problem, an inkjet recording device has been proposed which includes a waste ink absorbent. In this inkjet recording device, a moisturizing agent and a preservative are dissolved in an impregnating solution of the waste ink absorbent.

SUMMARY

According to the first aspect of the present disclosure, an inkjet recording device includes a recording head and a waste ink tray. The recording head is configured to eject droplets of ink. The waste ink tray is configured to receive the ink drained from the recording head. A surface of the waste ink tray, which receives the ink, is made of an antibacterial agent containing resin composition. A solubility of the antibacterial agent containing resin composition, which is measured by a measurement method (X), is 1.0 or higher and 3.0 or lower. The measurement method (X) includes: preparing a test piece of the antibacterial agent containing resin composition, which is square in shape with length and width of 1 cm and a thickness of 0.3 cm; immersing the test piece into water based ink with a weight of 10 g in a 25° C./50% RH environment; measuring a mass $W_1$ of the test piece after one-month immersion; and obtaining a solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

According to the second aspect of the present disclosure, a waste ink tray includes a surface configured to receive ink. The surface configured to receive the ink is made of an antibacterial agent containing resin composition. A solubility of the antibacterial agent containing resin composition, which is measured by a measurement method (X), is 1.0 or higher and 3.0 or lower. The measurement method (X) includes: preparing a test piece of the antibacterial agent containing resin composition, which is square in shape with length and width of 1 cm and a thickness of 0.3 cm; immersing the test piece into water based ink with a weight of 10 g in a 25° C./50% RH environment; measuring a mass $W_1$ of the test piece after one-month immersion; and obtaining a solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

According to the third aspect of the present disclosure, a waste ink collecting method using a waste ink tray includes allowing the waste ink tray to receive ink. A surface of the waste ink tray, which receives the ink, is made of an antibacterial agent containing resin composition. A solubility of the antibacterial agent containing resin composition, which is measured by a measurement method (X), is 1.0 or higher and 3.0 or lower. The measurement method (X) including: preparing a test piece of the antibacterial agent containing resin composition, which is square in shape with length and width of 1 cm and a thickness of 0.3 cm; immersing the test piece into water based ink with a weight of 10 g in a 25° C./50% RH environment; measuring a mass $W_1$ of the test piece after one-month immersion; and obtaining a solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

BRIEF DESCRIPTION OF THE DRAWINGS

FIG. 6 shows a receiving unit 60 of the inkjet recording device 1 according to one embodiment of the present disclosure, wherein

DETAILED DESCRIPTION

Embodiments of the present disclosure will be described in detail below. However, the present disclosure is not limited to the following embodiments and can be reduced to practice with appropriate variations applied within the scope of the object of the present disclosure. It is noted that duplicate description may be omitted appropriately, which however, does not limit the present disclosure.

An inkjet recording device according to the present disclosure includes a recording head and a waste ink tray. The recording head ejects a droplet of ink. The waste ink tray receives the ink drained from the recording head. A surface of the waste ink tray, which receives the ink, is made of a resin composition containing an antibacterial agent (hereinafter referred to as an "antibacterial agent containing resin composition"). The antibacterial agent containing resin composition has a solubility of 1.0 or higher and 3.0 or lower. The solubility is measured by a predetermined measuring method (e.g., a measuring method (X) described later).

A waste ink collecting method using a waste ink tray according to the present disclosure includes allowing the waste ink tray to receive ink. For example, this waste ink tray is the waste ink tray of the inkjet recording device according to the present disclosure.

The inkjet recording device and ink for an inkjet recording device, which is suitably used in this inkjet recording device (hereinafter referred merely to as ink) will be described below. Further, the waste ink tray provided in the inkjet recording device according to the present disclosure will be described in detail in the description of the inkjet recording device.

[Inkjet Recording Device]

A recording method to be employed in the inkjet recording device is not limited specifically and may be of serial type or line head type. The serial type is a recording scheme in which recording heads perform recording while performing scan on a recording medium. The line head type is a recording scheme in which recording heads fixed to the device body perform recording. In view of high speed image formation, the inkjet recording device more preferably includes the recording heads of line head type. The inkjet recording device preferably includes oblong recording heads of line head type which are disposed in the direction perpendicular to a direction in which a recording medium is conveyed.

With reference to the accompanying drawings, an inkjet recording device of a line head type will be described as an inkjet recording device according to one embodiment of the present disclosure. Further, the inkjet recording device in the present embodiment uses four colors (black, cyan, magenta, yellow) of ink, as an example. Hereinafter, the black color is denoted by "K". The cyan color is denoted by "C". The magenta color is denoted by "M". The yellow color is denoted by "Y".

Figure 1:
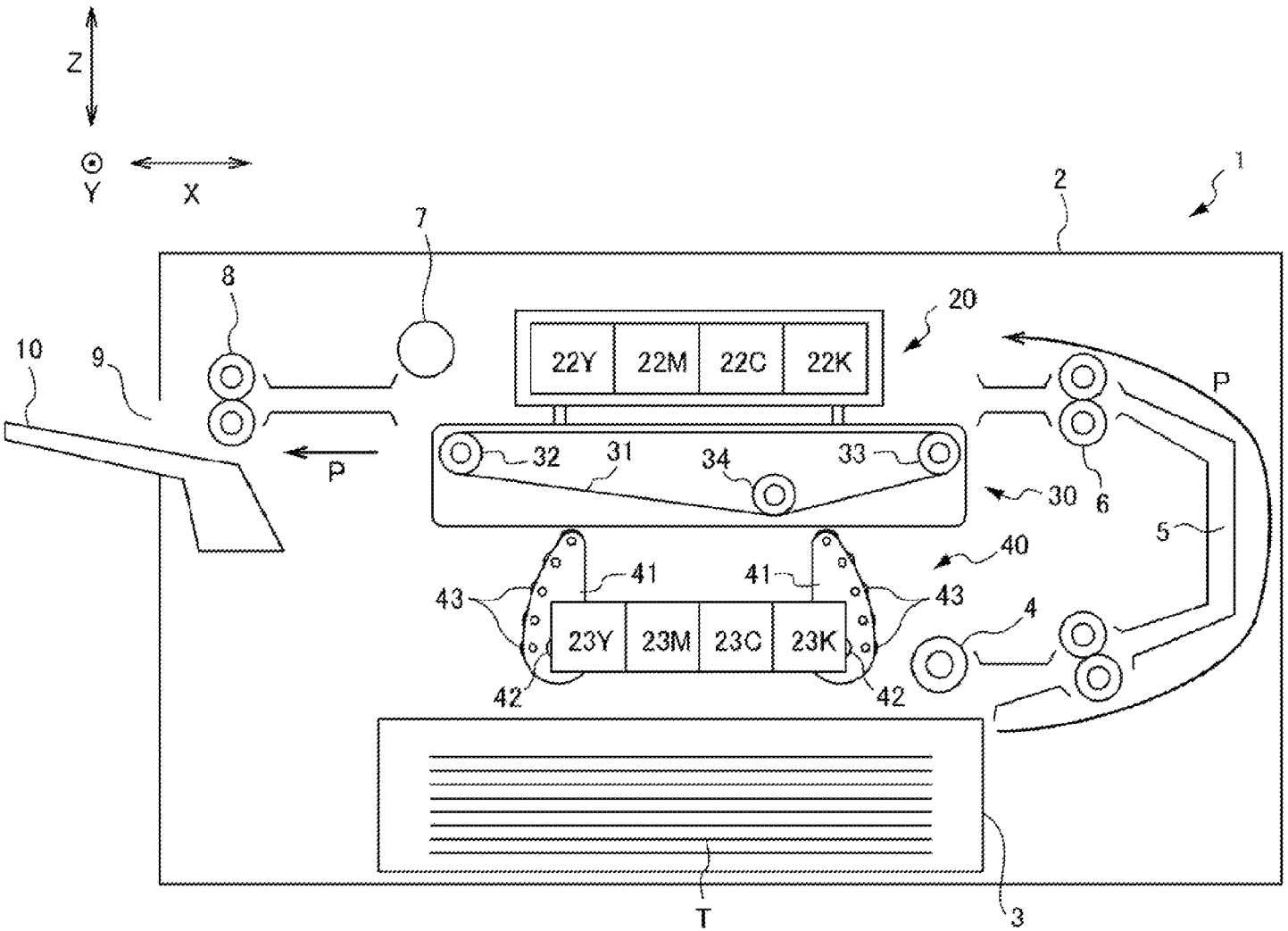
FIG. 1 is a vertical cross sectional view schematically showing a configuration of an inkjet recording device 1 as viewed from the front according to one embodiment of the present disclosure.
Figure 2:
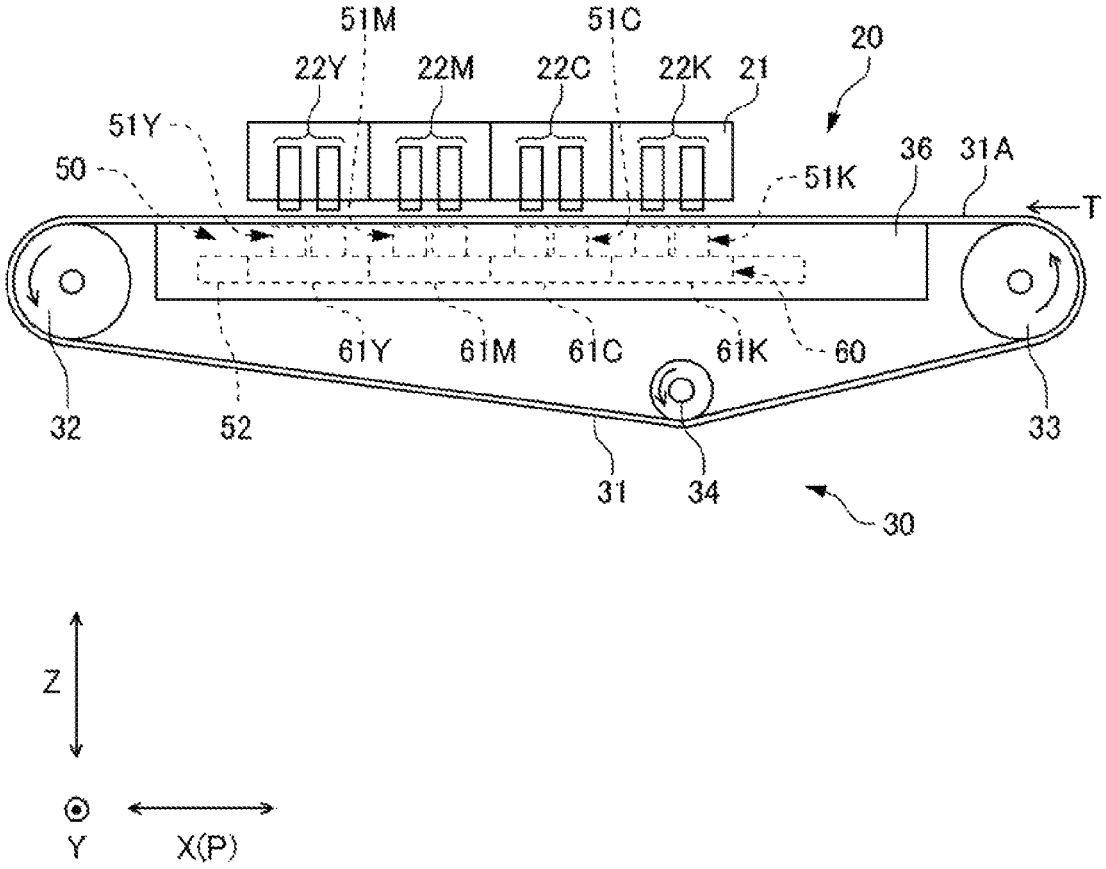
FIG. 2 is a diagram showing the peripheral part of a recoding section 20 and a conveyance unit 30 of the inkjet recording device 1 according to one embodiment of the present disclosure.
Figure 3:
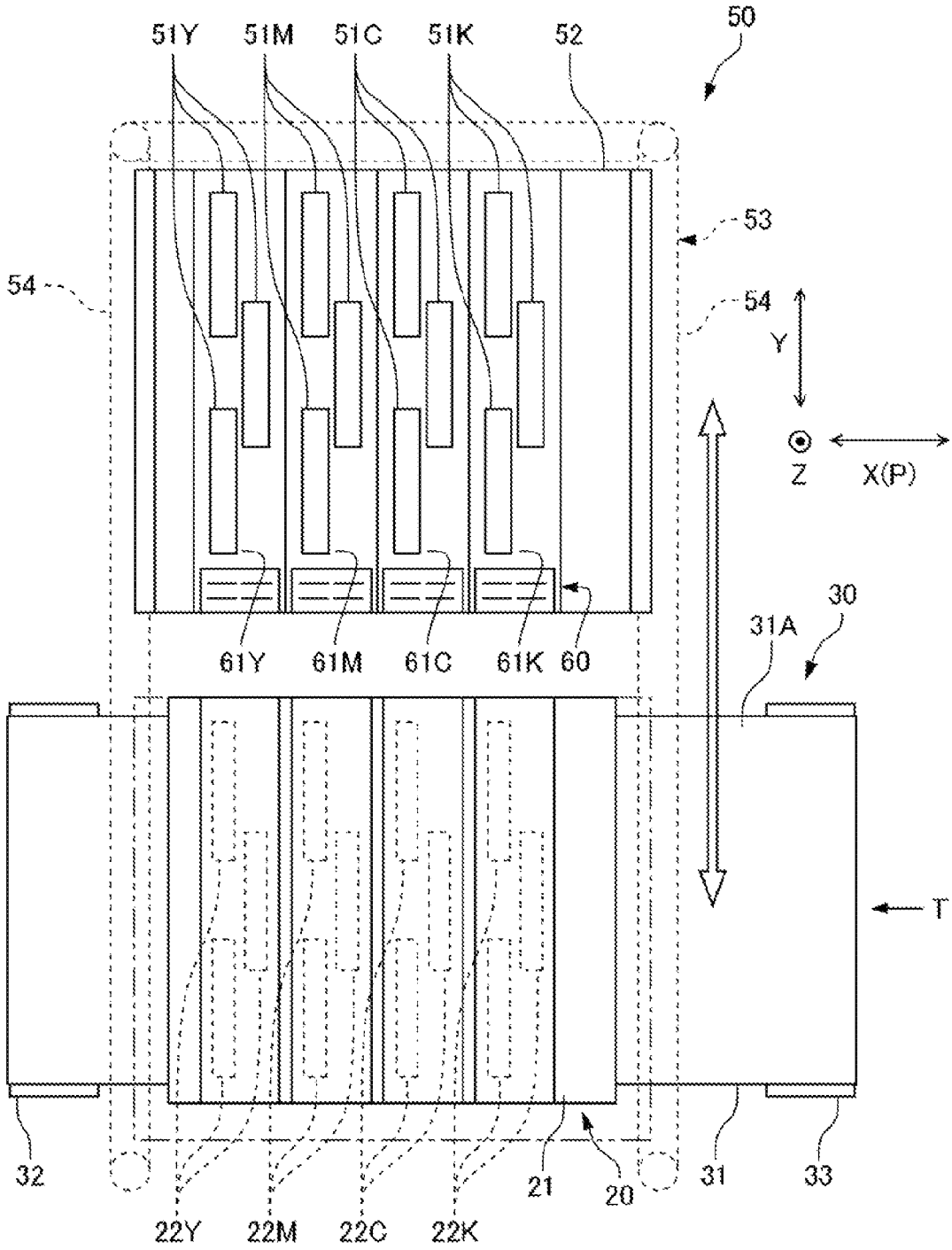
FIG. 3 is a plan view showing the peripheral part of the recording section 20, the conveyance unit 30, and a cap unit 50 of the inkjet recording device 1 according to one embodiment of the present disclosure.
Figure 4:
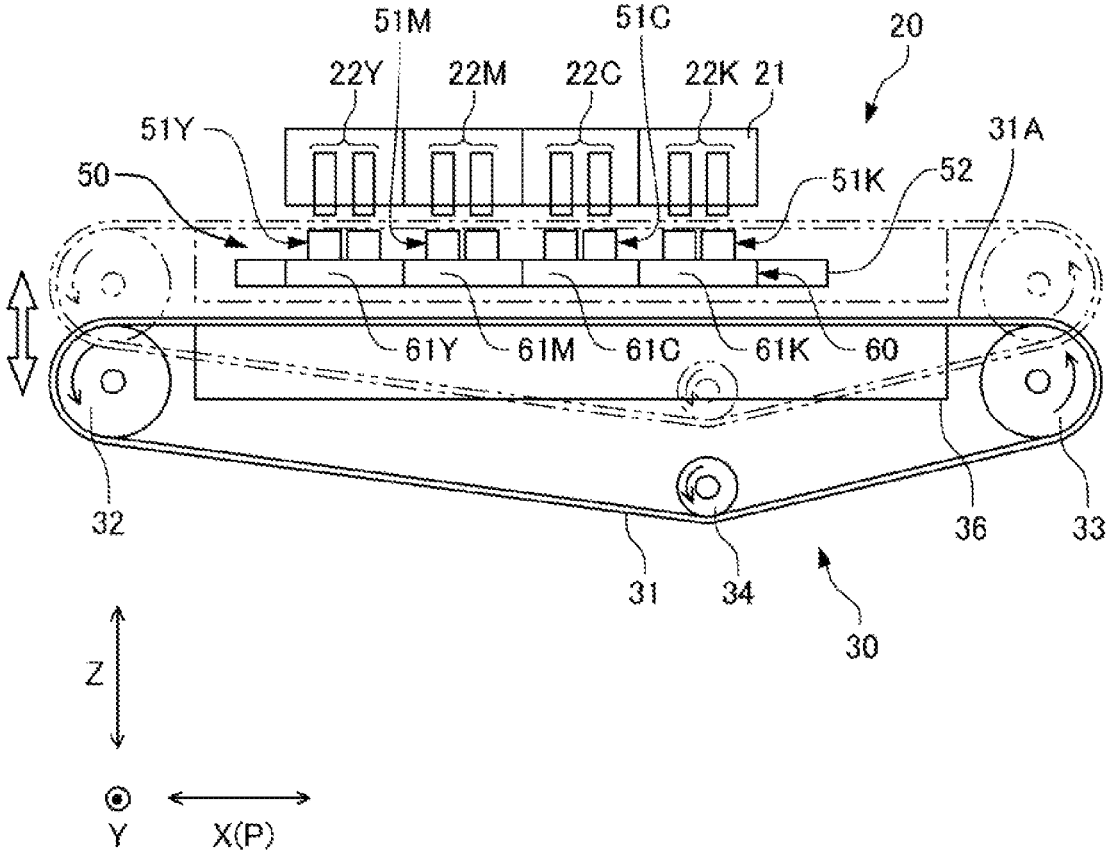
FIG. 4 is a front view showing a state when caps 51 move under in the inkjet recording device 1 shown in FIG. 2 according to one embodiment of the present disclosure.

With reference to FIGS. 1-4, description will be made about the overall structure of an inkjet recording device 1 according to one embodiment of the present disclosure. FIG. 1 is a vertical cross sectional view schematically showing the configuration of the inkjet recording device 1. FIG. 2 is a diagram showing the peripheral part of a recording section 20 and a conveyance unit 30 of the inkjet recording device 1. FIG. 3 is a plan view showing the peripheral part of the recording section 20, the conveyance unit 30, and a cap unit 50 of the inkjet recording device 1. FIG. 4 is a diagram showing a state when caps 51 move downward in the inkjet recording device 1 shown in FIG. 2.

As shown in FIGS. 1-4, the inkjet recording device 1 according to the present embodiment includes, in the interior of a main body 2, the recording section 20, the conveyance unit 30, a lifting device 40, and the cap unit 50.

The inkjet recording device 1 according to the present embodiment further includes a paper feed cassette 3, a paper feed roller 4, a paper conveyance path 5, a registration roller pair 6, a dryer 7, a paper delivery roller pair 8, a paper exit port 9, and an exit tray 10.

As shown in FIGS. 1-4, the conveyance unit 30 includes a drive roller 32, a driven roller 33, a conveyance belt 31, a tension roller 34, and an air suction unit 36. The conveyance belt 31 is wound between the drive roller 32 and the driven roller 33. The tension roller 34 adjusts the tension of the conveyance belt 31. Many through holes (not shown) for suction are formed in the conveyance belt 31 and the upper surface portion of the air suction unit 36.

When the drive roller 32 and the driven roller 33 rotate in the anticlockwise direction when viewed from the front, a conveyance surface 31A of the conveyance belt 31 is moved in a paper conveyance direction P parallel to the horizontal plane (X-Y plane). In other words, the paper conveyance direction P is substantially parallel to the horizontal direction X on the conveyance surface 31A of the conveyance belt 31. The upper surface portion of the conveyance belt 31 serves as the conveyance surface 31A. The air suction unit 36 is disposed below (on the opposite side of) the conveyance surface 31A.

The conveyance belt 31 may be an endless belt, a seamless belt, or the like. The endless belt is formed by overlapping and joining the opposite end portions of a belt. The seamless belt is a belt with no joint.

As shown in FIGS. 2 and 3, in predetermined recording, paper T as a recording medium is introduced onto the conveyance surface 31A from the upstream side of the conveyance belt 31 in a paper conveyance direction P. Suction force is generated on the conveyance surface 31A. The suction force acts on the conveyance surface 31A through the through holes for suction (not shown) by operation of the air suction unit 36. The paper T introduced onto the conveyance surface 31A is sucked to the conveyance surface 31A by the suction force to be conveyed in the paper conveyance direction P. Recording heads 22 of the recording section 20, which will be described later, eject ink toward the paper T, which is being conveyed on and sucked to the conveyance surface 31A. Thus, an image or the like is recorded (printed) on the paper T.

As shown in FIG. 1, the paper feed cassette 3 accommodates paper T in a layered manner. The paper feed cassette 3 is disposed at the upstream end in the paper conveyance direction P in the lower part of the main body 2. The paper feed roller 4 is disposed above the paper feed cassette 3. The paper feed roller 4 sends paper T toward upper right part of the paper feed cassette 3 in FIG. 1

The paper conveyance path 5, the registration roller pair 6, the recording section 20, and the conveyance unit 30 are disposed downstream of the paper feed cassette 3 in the paper conveyance direction P. The paper T sent out from the paper feed cassette 3 reaches the registration roller pair 6 through the paper conveyance path 5. The registration roller pair 6 corrects skew sending of the paper T and sends out again the paper T. A paper end sensor (not shown) is provided in the paper conveyance path 5 between the recording section 20 and the registration roller pair 6. The paper end sensor detects the tip end portion of the paper T. The recording section 20 performs ink ejection, which will be described later, on the basis of timing with which the tip end portion is detected.

As shown in FIG. 1, the dryer 7 is disposed downstream of the conveyance unit 30 in the paper conveyance direction P at the upper part in the interior of the main body 2. After the recording section 20 records an image or the like onto the paper T by ejecting the ink, the dryer 7 dries the ink ejected on the paper T.

The paper delivery roller pair 8, the paper exit port 9, and the exit tray 10 are disposed in this order on the downstream side of the dryer 7 in the paper conveyance direction P. When the dryer 7 terminates ink drying, the paper delivery roller pair 8 sends the paper T in the paper conveyance direction P. Then, the paper T is sent through the paper exit port 9 to the exit tray 10 provided on the exterior of the main body 2. Thus, the paper T is drained outside the main body 2.

As shown in FIGS. 1-3, the recording section 20 includes the recording heads 22 corresponding to the four colors. The recording heads 22 corresponding to the four colors are recording heads 22K for the black color, recording heads 22C for the cyan color, recording heads 22M for the magenta color, and recording heads 22Y for the yellow color. The recording heads 22K, 22C, 22M, and 22Y extend in the direction Y of the paper width orthogonal to the paper conveyance direction P (horizontal direction X). The recording heads 22K, 22C, 22M, and 22Y are disposed successively in the paper conveyance direction P of the conveyance belt 31. In the present embodiment, three recording heads 22K are disposed in the direction Y of the paper width in a staggered manner. Three recording heads 22C, three recording heads 22M, and three recording heads 22Y are disposed in the same manner.

As shown in FIG. 1, four ink tanks 23K, 23C, 23M, and 23Y are provided below the conveyance unit 30 correspondingly to the recording heads 22K, 22C, 22M, and 22Y for the four colors, respectively. The ink in the four colors is supplied from the respective four ink tank 23K, 23C, 23M, and 23Y through supply tubes (not shown) to the respective recording heads 22K, 22C, 22M, and 22Y for the four colors.

It is noted that in the following description, the characters "K", "C", "M", and "Y" are omitted so that the recording heads 22K, 22C, 22M, and 22Y are referred to as "recording heads 22", and the ink tanks 23K, 23C, 23M, and 23Y are referred to as "ink tanks 23", unless otherwise specifically defined. The terms, "caps 51", "waste ink trays 61", "first ink introducing inclined portions 62", and "ink flowing paths 67", etc. are referred to in the same manner.

The recording heads 22 for the four colors of the recording section 20 eject the ink in the respective four colors toward paper T placed on the conveyance surface 31A on the basis of image data (e.g., a letter, figure, or pattern) received from an external computer (not shown). As shown in FIGS. 2 and 3, each recording head 22 is supported by a recording head support member 21. Each recording head 22 is fixed to the main body 2 together with the recording head support member 21. When the conveyance belt 31 rotates and moves, the recording heads 22 for the four colors eject the ink in the respective four colors sequentially with predetermined timing. Thus, the ink in the four colors of black, cyan, magenta, and yellow are overlain on the paper T, thereby printing a color ink image on the paper T.

As a method for ink ejection from the recording heads 22, any of various ejection methods may be employed, such as a piezoelectric inkjet method, a thermal inkjet method, etc. The piezoelectric inkjet method is a method in which the ink is pushed out using a piezoelectric element (not shown). The thermal inkjet method is a method in which air bubbles are generated by a heating element (not shown) to apply the pressure to ink, thereby ejecting the ink.

As shown in FIG. 1, the lifting device 40 is disposed below the conveyance unit 30. The lifting device 40 moves up and down the conveyance unit 30 in a direction Z (hereinafter it may referred to as a vertical direction Z) perpendicular to the horizontal plane (X-Y plane) relative to the recording heads 22. Movement in the vertical direction Z of the conveyance unit 30 by the lifting device 40 can make the conveyance surface 31A to approach or separate from nozzle surfaces 221 (see FIG. 5) of the recording heads 22 relatively.

As shown in FIG. 1, the lifting device 40 includes eccentric cams 41 disposed below the conveyance belt 31. The eccentric cams 41 are disposed in pairs on the front side (front in the paper) and the back side (rear of the paper) of the conveyance unit 30 (i.e., four eccentric cams 41 in total). One and the other of each pair of the eccentric cams 41 are disposed on the upstream side and the downstream side in the paper conveyance direction P, respectively. An eccentric peripheral surface of each eccentric cam 41 approaches the outer bottom surface of the conveyance unit 30 from below. As shown in FIG. 1, each eccentric cam 41 includes a shaft 42 to cause the rotational axis of each eccentric cam 41 to be eccentric. The shaft 42 extends in the paper width direction Y. Each eccentric cam 41 is rotated about the shaft 42 by a motor (not shown). A plurality of bearings 43 are provided on the peripheral edge of each eccentric cam 41. A portion of the peripheral surface of each bearing 43 protrudes outward from the peripheral surface of the corresponding eccentric cam 41.

Each bearing 43 is rotatable about an axis parallel to the corresponding shaft 42. The bearings 43 are disposed successively from the tip end side of the corresponding eccentric cam 41 toward the corresponding shaft 42. In normal printing, as shown in FIG. 1, a bearing located the farthest from the corresponding shaft 42 comes into contact with the outer bottom surface of the conveyance unit 30 from below. Accordingly, the conveyance unit 30 is moved up to the highest point shown in FIG. 2.

From the state in which the conveyance unit 30 is at the highest point, the eccentric cams 41 on the upstream side in the paper conveyance direction P are rotated in the anticlockwise direction when viewed from the front, while the eccentric cams 41 on the downstream side in the paper conveyance direction P are rotated in the clockwise direction when viewed from the front. Accordingly, the bearings 43 come into contact with the outer bottom surface of the conveyance unit 30 sequentially from a bearing 43 furthest from the corresponding shaft 42 to a bearing 43 nearest the corresponding shaft 42 in this order. Thus, the conveyance unit 30 can be moved down.

The bearings 43 are disposed at predetermined regular intervals. The predetermined intervals are set so that two bearing 43 adjacent to each other in the peripheral direction of the respective eccentric cams 41 simultaneously come into contact with the outer bottom surface of the conveyance unit 30 for a while in rotation of the eccentric cams 41.

When the conveyance unit 30 is moved down by rotating the eccentric cams 41, the conveyance surface 31A separates from the recording heads 22 downwardly, as shown in FIG. 4. Thus, the cap unit 50 separates from the recording heads 22. Ink ejection nozzles (not shown) of the recording heads 22 eject the ink in the state in which the cap unit 50 separates from the recording heads 22. Thus, an ejection recovery process, that is, purging can be performed. The ejection recovery process is a process to obviate ink clogging by ejecting ink remaining in the ink ejection nozzles at a high viscosity.

By contrast, when the conveyance unit 30 is moved up by rotating the eccentric cams 41 in a direction reverse to the direction to move down the conveyance unit 30, the conveyance unit 30 is returned to the normal recording position (printing position), as shown in FIG. 2. This allows the cap unit 50 to be fit on the nozzle surfaces 221 of the recording heads 22.

As shown in FIGS. 2-4, in recording (printing), the cap unit 50 is located lower than the recording section 20 on the side of the recording section 20 (outside a paper conveyance region). Further, the cap unit 50 moves below the recording section 20 as needed. The cap unit 50 includes caps 51, waste ink trays 61, a cap base member 52, a sliding mechanism 53, and a perpendicular driving mechanism (not shown). The cap unit 50 is horizontally movable in the paper width direction Y by the sliding mechanism 53 (see FIG. 3). It is noted that the sliding mechanism 53 is not drawn in FIGS. 2 and 4.

The cap unit 50 is disposed in the upper part of the conveyance unit 30 and is movable up and down together with the conveyance unit 30 by the lifting device 40. Thus, the cap unit 50 allows the caps 51 to be detachable from the recording heads 22.

As shown in FIG. 3, the caps 51 for black, cyan, magenta, and yellow colors corresponding to the recording heads 22 for the four colors are disposed in the paper conveyance direction P (X) in this order. Three caps 51 are provided for each color (i.e., 12 caps 51 in total). The three caps 51 for each color are disposed correspondingly to the three recording heads 22. Hereinafter, the three caps 51 for each color may be referred to as "a cap 51 set".

The waste ink trays 61 are provided for the respective colors. The waste ink trays 61 are disposed below the respective cap 51 sets. The four waste ink trays 61 for the respective four colors are integrally formed together to form a receiving unit 60.

The cap base member 52 holds the caps 51 and the receiving unit 60.

As shown in FIG. 3, the sliding mechanism 53 extends in the paper width direction Y from the point where the recording section 20 and the conveyance unit 30 are provided toward the rear side (upper side in the paper) of the recording section 20 and the conveyance unit 30. The sliding mechanism 53 includes two endless transfer belts 54. The two transfer belts 54 are disposed with space left so as to be orthogonal to the paper conveyance direction P.

The cap base member 52 is disposed over the two transfer belts 54 and is supported by the two transfer belts 54. Accordingly, as shown in FIG. 3, the sliding mechanism 53 can slide and move the cap base member 52 between a fitting position (indicated by the dashed and double dotted line) and a withdrawal position. The fitting position is located below the recording section 20. The withdrawal position is located on the rear side of the recording section 20 more than the position where the recording section 20 is disposed. That is, the sliding mechanism 53 allows the caps 51 to be positioned at two positions relative to the recording heads 22 of the fitting position below the recording heads 22 and the withdrawal position on the rear side of the recording section 20.

The cap unit 50 allows the caps 51 to be fitted to the recording heads 22. A fitting operation will be described below.

In fitting the caps 51 to the recording heads 22, the inkjet recording device 1 allows the lifting device 40 (see FIG. 1) to move the conveyance unit 30 down from the usual position at printing, as shown in FIG. 4. This forms a gap between the recording section 20 including the recording heads 22 and the conveyance unit 30.

Thereafter, the sliding mechanism 53 inserts the cap base member 52 in the gap formed between the recording head 22 and the conveyance unit 30. Accordingly, the cap base member 52 is located below the recording heads 22. Then, the perpendicular driving mechanism (not shown) moves up the cap base member 52. Thus, the caps 51 come into contact with the nozzle surfaces 221 (see FIG. 5) on the bottom surfaces of the recording heads 22 to be fitted thereto. As the perpendicular driving mechanism, a mechanism to synchronously drive cams or the like disposed on the four corners of the base cap member 52 or the like may be employed, for example.

Figure 5:
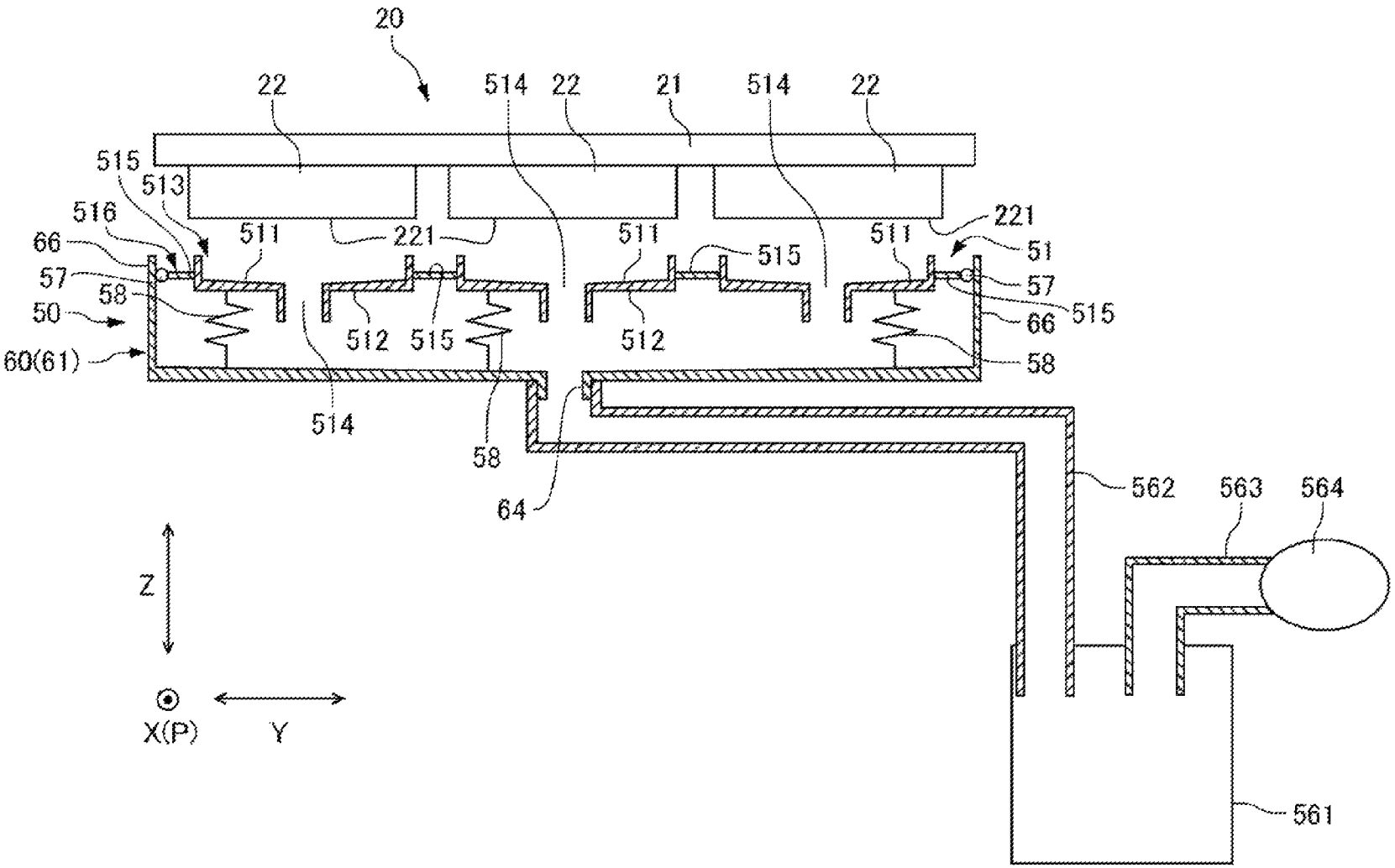
FIG. 5 is a vertical cross sectional view schematically showing an overall structure of the cap unit 50 according to one embodiment of the present disclosure.
Figure 6A:
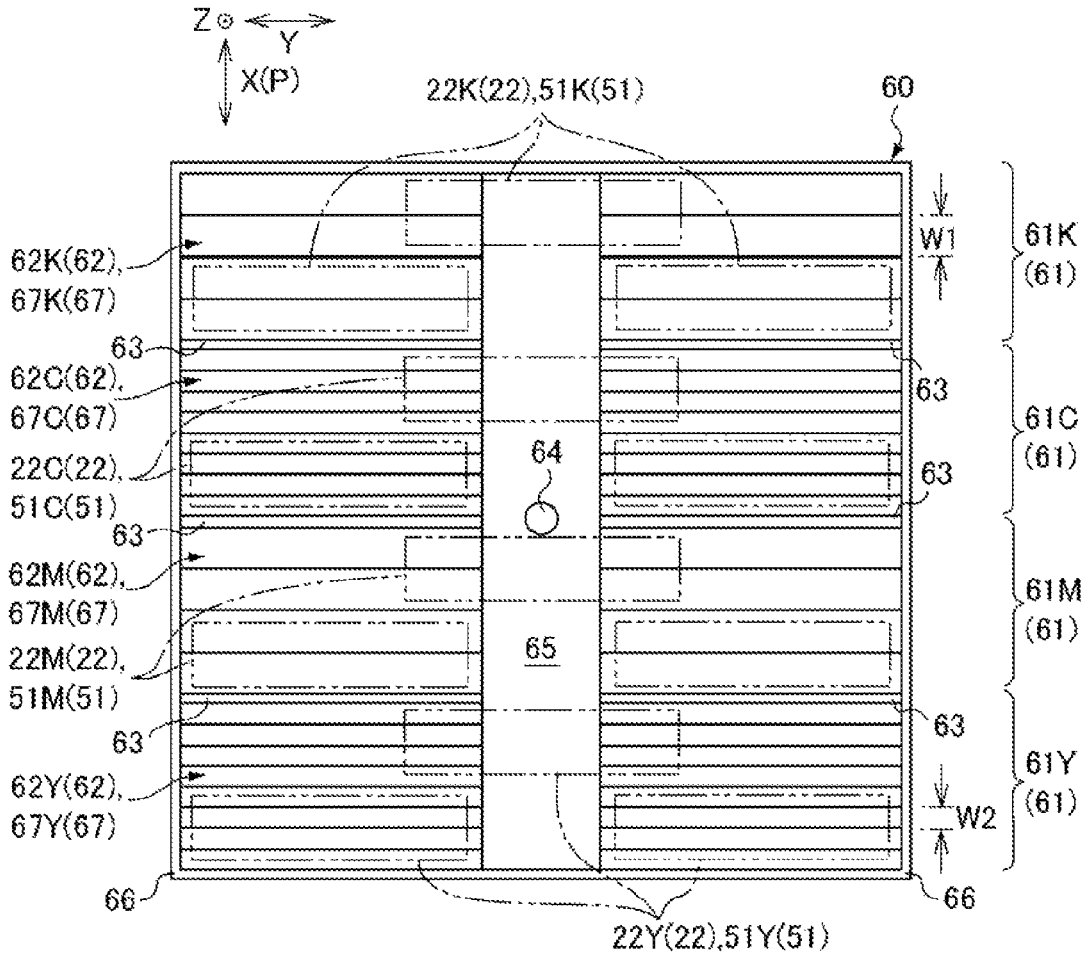
FIG. 6A is a plan view.
Figure 6B:
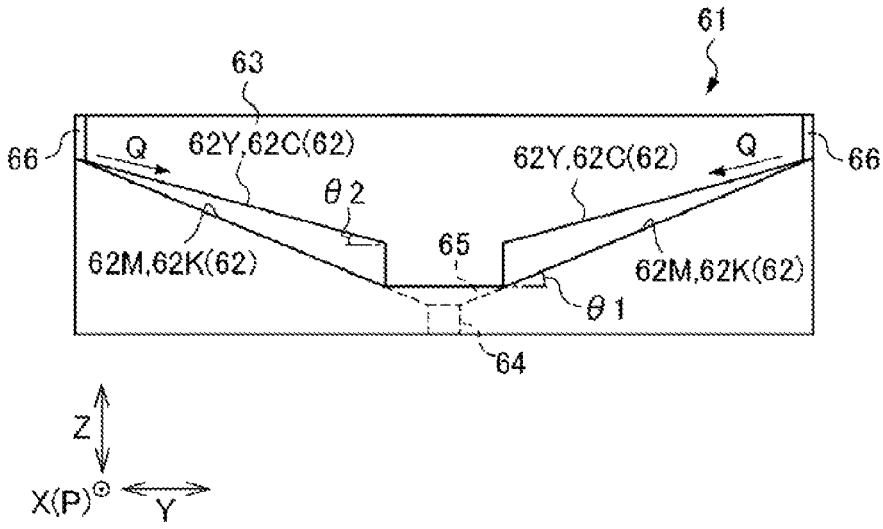
FIG. 6B is a cross sectional view.

With reference to FIGS. 5 and 6, the cap unit 50 and the receiving unit 60 of the inkjet recording device 1 according to the present embodiment will be described next. FIG. 5 is a vertical cross sectional view schematically showing the overall structure of the cap unit 50. FIG. 6 is a diagram showing the receiving unit 60 according to the present embodiment, wherein FIG. 6A is a plan view of the receiving unit 60, and FIG. 6B is a cross sectional view of the receiving unit 60.

As shown in FIG. 5, the cap unit 50 includes the caps 51, the receiving unit 60 (waste ink trays 61), a waste ink container 561, a tube 562, a tube 563, and a pump 564 for ink collection.

As shown in FIG. 3, the recording heads 22 and the caps 51 for each color are arranged in a staggered manner in the paper width direction Y when viewed in plan. However, for the sake of convenience, the recording heads 22 and the caps 51 for each color are arranged linearly in the paper width direction Y in FIG. 5.

As shown in FIG. 3, the three caps 51 are provided correspondingly to the three recording heads 22 for each color. Each cap 51 can be disposed below the corresponding recording head 22. As shown in FIG. 6, each waste ink tray 61 is disposed below the corresponding three caps 51 for each color. Each waste ink tray 61 has a size which can include the three caps 51 when viewed in plan. The waste ink container 561 is disposed at a position not interfering with the conveyance unit 30. The tube 562 allows a first ink drain hole 64, which will be described later, of the waste ink trays 61 to communicate with the waste ink container 561. The pump 564 communicates with the waste ink container 561 through the tube 563.

As shown in FIG. 5, the caps 51 function as members to receive ink drained from the ink ejection nozzles (not shown) of the recording heads 22. Each cap 51 includes a second bottom wall portion 512, a second peripheral wall portion 513, and a second ink drain hole 514 as a second ink drain section. The second bottom wall portion 512 forms a second bottom surface 511.

As shown in FIG. 5, the second bottom surface of each cap 51 faces the nozzle surface 221 of the corresponding recording head 22. The second bottom surface 511 inclines downward from the second peripheral wall portion 513 toward the second ink drain hole 514.

The second peripheral wall portion 513 stands upward from the peripheral edge of the second bottom wall portion 512. The second ink drain hole 514 is formed in the central part of the second bottom surface 511. The second ink drain hole 514 is a hole to drain ink that the second bottom surface 511 receives to the corresponding waste ink tray 61 located below the corresponding cap 51.

The caps 51 can be disposed between the recording heads 22 and the waste ink trays 61 correspondingly to the recording heads 22. The caps 51 receive ink drained from the ink ejection nozzles and drain the received ink from the second ink drain holes 514 to the waste ink trays 61. Further, the three caps 51 are integrally formed together in a manner that the outer surfaces of the respective second peripheral wall portions 513 are joined by joint plates 515 to form a second cap unit 516. The second cap unit 516 is made of a resin material integrally.

The waste ink trays 61 will be described next in detail.

[Waste Ink Tray]

Each of the waste ink trays 61 of the inkjet recording device according to the present disclosure is not limited specifically as far as it is movably disposed below the recording heads 22 and serves as a member to receive ink drained from the nozzles.

Preferably, each waste ink tray 61 can be disposed below the recording heads 22 for each of the four colors correspondingly, as shown in FIG. 6. The waste ink tray 61 includes first ink introducing inclined portions 62, partition walls 63 as a partition portion, the first ink drain hole 64 as a first ink drain section, a trough portion 65, and first side wall portions 66.

The first ink introducing inclined portions 62 incline so as to guide the ink which the waste ink tray 61 receives to the first ink drain hole 64. The first ink introducing inclined portions 62 are provided in pair for each color. The paired first ink introducing inclined portions 62 are provided apart from each other in the paper width direction Y and incline downward toward the trough portion 65.

Each first ink introducing inclined portion 62 includes a plurality of ink flowing paths 67. The ink flowing paths 67 extend in a direction Q in which the ink flows in the first ink introducing inclined portion 62. The ink flowing paths 67 are defined in the flowing direction Q. Each of the waste ink tray 61Y and the waste ink tray 61C includes eight ink flowing paths 67. Each of the waste ink tray 61M and the waste ink tray 61K includes four ink flowing paths 67.

The inclination angle θ1 of the ink flowing paths 67 (first ink introducing inclined portions 62) of the waste ink tray 61M and the waste ink tray 61K is larger than the inclination angle θ2 of the ink flowing paths 67 (first ink introducing inclined portions 62) of the waste ink tray 61Y and the waste ink tray 61C. The width W1 of the ink flowing paths 67 of the waste ink tray 61M and the waste ink tray 61K is larger than the width W2 of the ink flowing paths 67 of the waste ink tray 61Y and the waste ink tray 61C.

The partition wall 63 partitions the first ink introducing inclined portions 62 adjacent in the paper conveyance direction P. The partition wall 63 extends in the paper width direction Y.

The trough portion 65 is contiguous with each lower end portion of each paired first ink introducing inclined portion 62 in the inclination direction Q. The trough portion 65 extends in the paper conveyance direction P (X) over the four waste ink trays 61. The trough portion 65 inclines downward toward the first ink drain hole 64. Accordingly, the ink dripped on the trough portion 65 is guided to the first ink drain hole 64. The ink flowing on the first ink introducing inclined portions 62 is dripped on and temporarily retained in the trough portion 65.

One first ink drain hole 64 is formed in the central part of the trough portion 65 for the plurality of waste ink trays 61 to drain the ink received by the plurality of waste ink trays 61 together.

The first side wall portions 66 stand upward from the upper end portions in the inclination direction of the first ink introducing inclined portions 62. Each first side wall portion 66 extends in the paper conveyance direction P (X) over the four waste ink trays 61.

Each waste ink tray 61 receives the ink drained from the ink ejection nozzles (not shown) and drains the received ink from the first ink drain hole 64. In the present embodiment, each waste ink tray 61 receives the ink drained from the ink ejection nozzles through the second ink drain holes 514 of the corresponding the caps 51.

The four waste ink trays 61 corresponding to the caps 51 for the four colors (three for each color) are integrated together to form the receiving unit 60. In other words, the plurality of waste ink trays 61 are formed integrally.

As shown in FIG. 5, sealants 57 intervene between the inner surfaces of the first side wall portions 66 and the outer peripheral edges of the corresponding joint plates 515 of the second the cap unit 516. Thus, sealing portions are formed. Intervention of the sealants 57 allows the outer peripheral edges of the second cap unit 516 to tightly adhere to the inner surfaces of the first side wall portions 66 of the waste ink trays 61. Thus, ventilation between the second the cap unit 516 and the waste ink trays 61 is inhibited, thereby achieving smooth ink drain.

Materials for the waste ink tray 61 will be described next.

In the inkjet recording device according to the present disclosure, at least the surface of each waste ink tray 61, which receives the ink, is made of an antibacterial agent containing resin composition. The antibacterial agent containing resin composition has a solubility of 1.0 or higher and 3.0 or lower when measured by a measurement method (X).

Measurement method (X):

1) A test piece of the antibacterial agent containing resin composition is prepared. The test piece is square in shape with length and width of 1 cm and a thickness of 0.3 cm.

2) The test piece is immersed into water based ink with a weight of 10 g in a 25° C./50% relative humidity (RH) environment.

3) The mass $W_1$ of the test piece is measured after one-month immersion.

4) The solubility of the antibacterial agent containing resin composition is obtained from a mass $W_0$ of the test piece before the immersion in the water based ink and the mass $W_1$ of the test piece after the immersion on the basis of an equation (a):

$$\text{Solubility}=(1-W_1/W_0)\times 100 \quad \text{(a)}$$

<<Solubility>>

The solubility of the antibacterial agent containing resin composition is a solubility in water based ink, as will be described later, which is suitably used in the inkjet recording device according to the present disclosure. The solubility is measured by the measurement method (X).

Where the solubility of the antibacterial agent containing resin composition measured by the measurement method (X) is 1.0 or higher and 3.0 or lower, waste ink that the waste ink trays 61 receive dissolves the resin in the antibacterial agent containing resin composition at favorable speed. Accordingly, an antibacterial agent of a sufficient amount to suppress a bacteria breeding can be supplied to the waste ink retained in the waste ink trays 61. Further, degradation of the members of the waste ink trays 6, which may be caused by the waste ink, can be reduced.

By contrast, where the solubility is too low, although degradation of the members of the waste ink trays 6, which may be caused by the waste ink, can be reduced sufficiently, it is difficult to supply a sufficient amount of the antibacterial agent to the waste ink retained in the waste ink trays 61, because the speed at which the resin in the antibacterial agent containing resin composition is dissolved is low. Thus, a bacterium breeding is difficult to suppress. On the other hand, where the solubility is too high, it is possible to supply the antibacterial agent of which amount is sufficient to suppress a bacteria breeding. However, it is difficult to reduce degradation of the members of the waste ink trays 61, which may be caused by the waste ink.

The solubility of the antibacterial agent containing resin composition to be measured by the measurement method (X) can be adjusted by mixing two or more types of polymers as the resin contained in the antibacterial agent containing resin composition, for example.

The configuration of each waste ink tray 61 is not limited specifically as far as at least the surface that receives ink is formed of the antibacterial agent containing resin composition. The structure of the waste ink tray 61 may be a single layer structure, two-layer structure, multilayer structure, etc., for example. A waste ink tray having a single layer structure is composed of only a layer formed of the antibacterial agent containing resin composition. A waste ink tray having a two-layer structure is composed of an upper layer, which receives the ink and is formed of the antibacterial agent containing resin composition, and a lower layer. In the waste ink tray having a multilayer structure, one or both of an upper layer and a lower layer includes a plurality of layers. The structure of the waste ink tray 61 is preferably the two-layer structure or the multilayer structure in view of durability and toughness.

Where the waste ink tray 61 has the multilayer structure, examples of the material for the lower layer may include resin materials, metal materials, alloy materials, etc. Examples of the resin materials may include, for example, polypropylene resin, polyethylene resin (PE), polystyrene resin (PS), acrylonitrile-butadiene-styrene copolymer (ABS) resin, elastomer, polyester resin (PET), nylon resin (PA), polyvinyl chloride resin (PVC), polycarbonate (PC), etc. Examples of the metal materials may include stainless, aluminum, etc., for example. The alloy materials may be alloys composed of a plurality of metal materials, for example.

Among of them, the resin materials are preferable in view of strength, weight, economic efficiency, and moldability. Among the resin materials, polycarbonate resin and/or polystyrene resin is/are preferable.

In the antibacterial agent containing resin composition that forms the surface of each waste ink tray 61, which receives the ink, the resin contains an antibacterial agent as an essential component. The resin, the essentially contained antibacterial agent, and a component contained as an optional component other than the antibacterial agent will be described below.

(Resin)

The types of the resin used in the antibacterial agent containing resin composition are not limited within the scope not inhibiting the object of the present disclosure. The resin can be appropriately selected from resin used for waste ink trays in general inkjet recording devices. Specific examples of suitable resin may include polypropylene resin, polyethylene resin (PE), ABS resin, elastomer, polyester resin (PET), nylon resin (PA), polyvinyl chloride resin (PVC), methacryl resin, polycarbonate/ABS resin blends, polycarbonate/AS (acrylonitrile-styrene copolymer) resin blends, etc. Among these resins, the ABS resin is particularly preferable as the resin used in the antibacterial agent containing resin composition in view of the solubility in the ink, which will be described later, suitably used for the inkjet recording device according to the present disclosure.

Further, the resin used in the antibacterial agent containing resin composition has preferably an impact strength of 15 $kJ/m^2$ or higher and 30 $kJ/m^2$ or lower and a flexural strength of 50 $kJ/m^2$ or higher and 100 $kJ/m^2$ or lower. The impact strength may be measured by a Charpy impact strength test according to ISO 179. The flexural strength may be measured by a flexural strength test according to ISO 178.

(Antibacterial Agent)

The types of the antibacterial agent contained in the antibacterial agent containing resin composition are not limited specifically within the scope not inhibiting the object of the present disclosure. The antibacterial agent may be appropriately selected from antibacterial agents used in ink for general inkjet recording devices and the like. Specific suitable examples of the antibacterial agent may include benzimidazol based antibacterial agents, triazole based antibacterial agents, etc. The benzimidazol based antibacterial agents may be methyl-2-benzimidazole carbamate (MBC), 2-(4-thiazolyl)-benzimidazole, etc., for example. The triazole based antibacterial agent, may be, for example, α-[2-(4-chlorophenyl)ethyl]-α-(1,1-dimethylethyl)-1H-1,2,4-triazole-1-ethanol (tebuconazole), 1-[[2-(2,4-dichlorophenyl)-4-n-propyl-1,3-dioxolane-2-yl]methyl]-1H-1,2,4-triazole (propiconazole), 1-[[2-(2,4-dichlorophenyl)-1,3-dioxolane-2-yl]methyl]-1H-1,2,4-triazole (azaconazole), α-(4-chlorophenyl)-α-(1-cyclopropylethyl)-1H-1,2,4-triazole-1-ethanol (cyproconazole), etc. Among of them, the triazole based antibacterial agents are particularly preferable. Of the triazole based antibacterial agents, α-[2-(4-chlorophenyl)ethyl]-α-(1,1-dimethylethyl)-1H-1,2,4-triazole-1-ethanol is particularly preferable.

The content of the antibacterial agent contained in the antibacterial agent containing resin composition is not limited specifically within the scope not inhibiting the object of the present disclosure. The content of the antibacterial agent contained in the antibacterial agent containing resin composition is preferably 1 part or more and 5 parts or less relative to the resin of 100 parts contained in the antibacterial agent containing resin composition.

(Component Other than Antibacterial Agent)

The antibacterial agent containing resin composition may contain a component other than the antibacterial agent. The component other than the antibacterial agent may be a plasticizer, etc. Examples of the plasticizer may include, for example, phthalate ester, adipate ester, phosphate ester, etc. The content of the component other than the antibacterial agent is preferably 0.5 parts or more and 5 parts or less relative to the resin of 100 parts which is contained in the antibacterial agent containing resin composition.

<Method for Manufacturing Waste Ink Tray>

A method for manufacturing the waste ink tray 61 is not limited specifically within the scope not inhibiting the object of the present disclosure and can be appropriately selected from general methods. One example of a method for manufacturing the waste ink tray 61 having a single layer structure may be, for example, a method for molding a antibacterial agent containing resin composition using a method similar to any known method for manufacturing a plastic article.

Further, examples of a method for manufacturing the waste ink tray 61 having a multilayer structure may include the following first, second, and third manufacturing methods. The first manufacturing method is a method in which a plurality of layers are integrally molded. The second manufacturing method is a method in which an upper layer and a lower layer or a plurality of layers are formed separately, followed by joining them together by bonding or seizing. The third manufacturing method is a method in which a lower layer is formed followed by applying a coating containing the antibacterial agent containing resin composition to the surface of the lower layer. Among of these methods, the first manufacturing method is preferable as a method for manufacturing the waste ink tray 61 because the manufactured waste ink tray 61 can exhibit excellent durability, mechanical characteristics, and economic efficiency. It is noted that the method for molding the resin is not limited specifically, but may be any of various methods, such as compression molding, transfer molding, injection molding, extrusion molding, blow molding, etc.

Moreover, a method for allowing the resin to contain the antibacterial agent in molding the antibacterial agent containing resin composition into the waste ink tray is not limited specifically within the scope not inhibiting the object of the present disclosure. One example of the method for allowing the resin to contain the antibacterial agent may be, for example, a method in which layered silicate supporting the antibacterial agent among its layers is mixed with a melt of the resin. The layered silicate may be inorganic filler generally used in resin molded articles. Even with the antibacterial agent supported among the layers of the layered silicate, the waste ink which the waste ink tray 61 receives comes into contact with the antibacterial agent. Accordingly, the antibacterial agent is dissolved into the waste ink to exhibit antibacterial effects in the waste ink. Further, since the layered silicate as inorganic filler supports the antibacterial agent, even when the resin composition is heated for fusing in molding the resin composition, decomposition of the antibacterial agent can be reduced.

As shown in FIG. 5, one end portion (upper end portion) of the tube 562 is connected to the first ink drain hole 64 of the waste ink trays 61. The other end portion (lower end portion) of the tube 562 is connected to the waste ink container 561 to be open toward the interior of the waste ink container 561. Accordingly, the ink received by the waste ink trays 61 and drained together from the first ink drain hole 64 flows into the waste ink container 561 through the tube 562 to be retained.

Moreover, as shown in FIG. 5, compression springs 58 are provided in the vertical direction Z between the respective caps 51 and the waste ink tray 61. In the state in which the cap unit 50 is lifted up toward the recording heads 22 together with the conveyance unit 30 by the lifting device 40 so that each cap 51 covers the nozzle surface 221 of the corresponding recording head 22, the compression springs 58 bias and elastically move each cap 51 toward the corresponding nozzle surface 221.

[Ink for Inkjet Recording Device]

The ink suitably used for the inkjet recording device according to the present disclosure contains water, a pigment dispersion, and an organic solvent, as needed. The organic solvent may contain a moisturizing agent, a solution stabilizer, etc. The moisturizing agent can suppress volatilization of a liquid component from the ink to stabilize the viscosity of the ink. The solution stabilizer can stabilize the solution state of the components contained in the ink. It is noted that the ink in the present disclosure contains pigment and resin as a pigment dispersion. Description will be made below sequentially about water, the pigment dispersion, the pigment and resin contained in the pigment dispersion, the organic solvent, the moisturizing agent, and the solution stabilizer as essential or optional components, which the ink for the inkjet recording device contains, and a method for manufacturing the ink for the inkjet recording device.

[Water]

The ink used for the inkjet recording device according to the present disclosure is water based ink, and therefore, contains water as an essential element. The water contained in the ink is not limited specifically within the scope not inhibiting the object of the present disclosure and can be appropriately selected from water with a desired purity from water used in manufacture of general water based ink. The content of the water contained in the ink used for the inkjet recording device the present disclosure is not limited specifically within the scope not inhibiting the object of the present disclosure. The content of the water can be appropriately changed according to the content of the other components, which will be described later. Typically, the content of the water in the ink is preferably 35 mass % or higher and 80 mass % or lower and more preferably 40 mass % or higher and 75 mass % or lower relative to the total mass of the ink.

[Pigment Dispersion]

The ink used for the inkjet recording device according to the present disclosure contains a pigment dispersion. The pigment dispersion contains pigment as a colorant and resin. It is noted that the pigment dispersion can contain glycerin and the like as a moisturizing agent that can be contained in the ink, which will be described later. Further, a liquid medium used for manufacturing the pigment dispersion may be water, an organic solvent, etc.

(Pigment)

The pigment that can be contained in the pigment dispersion is not limited specifically within the scope not inhibiting the object of the present disclosure and can be appropriately selected from pigment used as a colorant for ink for general inkjet recording devices. Specific suitable examples of the pigment may include yellow pigment, orange pigment, red pigment, blue pigment, violet pigment, black pigment, etc. The yellow pigment may be, for example, C.I. pigment yellow 74, 93, 95, 109, 110, 120, 128, 138, 139, 151, 154, 155, 173, 180, 185, 193, etc. The orange pigment may be, for example, C.I. pigment orange 34, 36, 43, 61, 63, 71, etc. The red pigment may be, for example, C.I. pigment red 122, 202, etc. The blue pigment may be, for example, C.I. pigment blue 15, etc. The violet pigment may be, for example, C.I. pigment violet 19, 23, 33, etc. The black pigment may be, for example, C.I. pigment black 7, etc.

The amount of use of the pigment contained in the pigment dispersion is not specifically limited within the scope not inhibiting the object of the present disclosure. Typically, the amount of use of the pigment in the ink is preferably 2 mass % or higher and 15 mass % or lower relative to the total mass of the ink. With too small amount of use of the pigment, it is difficult to obtain an image with desired image density. By contrast, too many amount of use of the pigment may lead to reduction in flowability of the ink, thereby making it difficult to form a favorable image. Further, the permeability of the ink to a recording medium may be reduced, thereby readily causing offset.

(Resin to be Contained in Pigment Dispersion)

The resin to be contained in the pigment dispersion is not limited specifically within the scope not inhibiting the object of the present disclosure and can be appropriately selected from various resins used in manufacture of general pigment dispersions. Specific suitable examples of the resin may include styrene-acrylate-alkyl acrylate ester copolymer, styrene-methacrylate-methacrylic alkyl ester-alkyl acrylate ester copolymer, styrene-acrylate copolymer, styrene-maleate copolymer, styrene-maleate-alkyl acrylate ester copolymer, styrene-methacrylate copolymer, styrene-methacrylic alkyl ester copolymer, styrene-maleate half-ester copolymer, vinylnaphthalene-acrylate copolymer, vinylnaphthalene-maleate copolymer, etc.

Among these resins, styrene-acrylate based resins are preferable because of their easy preparation and excellent dispersion effects in pigment. The styrene-acrylate based resin may include a unit based on styrene and a unit based on acrylic acid, methacrylic acid, acrylic acid ester, or methacrylic acid ester. Examples of the styrene-acrylate based resins may include styrene-acrylate-alkyl acrylate ester copolymer, styrene-methacrylate-methacrylic alkyl ester-alkyl acrylate ester copolymer, styrene-acrylate copolymer, styrene-maleate-alkyl acrylate ester copolymer, styrene-methacrylate copolymer, styrene-methacrylic alkyl ester copolymer, etc.

The weight average molecular weight (Mw) of the resin used for preparation of the pigment dispersion is not limited specifically within the scope not inhibiting the object of the present disclosure. However, typically, it is preferably to be 10,000 or larger and 160,000 or smaller. Where the molecular weight of the resin is too small, an image with desired image density can be hardly obtained in forming an image on a recording medium. By contrast, where the molecular weight is too large, which means that the ink has high viscosity, volatilization of the solvent and the like may tend to further increase the viscosity of the ink, thereby readily causing ink ejection failure in the nozzles. This means that too large molecule weight of the resin may lead to difficulty in formation of a favorable image. For example, the suitable molecular weight of the resin can be adjusted by any known method for adjusting the amount of use of a polymerization initiator, the temperature for polymerization, a polymerization time period, or the like. The weight average molecular weight (Mw) of the resin contained in the pigment dispersion can be measured by gel filtration chromatography. Too small molecular weight of the resin may cause strike through in a recording medium after image formation. By contrast, too high molecular weight thereof may impair the characteristic of intermittent ink ejection.

Further, the acid value of the resin used for preparation of the pigment dispersion is preferably 150 mg KOH/g or larger and 250 mg KOH/g or smaller. A too small acid value of the resin may result in low dispersibility of the pigment in the pigment dispersion to lead to difficulty in making the pigment particulate. Therefore, it may be difficult to obtain an image with favorable colorability and color formability. A too large acid value of the resin may reduce preservation stability of the ink. The acid value of the resin can be adjusted by appropriately adjusting the amount of use of a monomer having an acidic functional group (e.g., a carboxy group), such as acrylate, methacrylate, etc. in synthesizing the resin. Specifically, the acid value can be increased by increasing the amount of use of the monomer having an acidic functional group.

The amount of use of the resin for adjusting the pigment dispersion is not limited specifically within the scope not inhibiting the object of the present disclosure. Typically, the amount of use of the resin is preferably 2 mass % or higher and 30 mass % or lower relative to the total mass of the pigment dispersion. Where the amount of use of the resin relative to the total mass of the pigment dispersion is too small, strike through may occur in a recording medium after image formation. By contrast, where the amount of use is too large, the ink may tend not to spread over a recording medium, thereby obtaining no image with desired density.

The method for manufacturing the pigment dispersion containing the pigment and the resin is not limited specifically within the scope not inhibiting the object of the present disclosure and can be appropriately selected from general methods. One suitable example may be a method in which the pigment and the resin are milled in an appropriate liquid medium, such as water, using a media type wet disperser to obtain the pigment dispersion. The media type wet disperser may be, for example, NANO GRAIN MILL (product by ASADA IRON WORKS. CO., LTD.), MSC MILL (product by Mitsui Mining Co., Ltd.), DYNO-MILL (product by SHINMARU ENTERPRISES CORPORATION), or the like. The process using the media type wet disperser uses beads with a small grain diameter. The grain diameter of the beads is not limited specifically and may be typically 0.2 mm or larger and 1.0 mm or smaller. Further, a material for the beads are not limited specifically and may be a hard material, such as glass, zirconia, etc.

The amount of use of a liquid medium in manufacturing the pigment dispersion is not limited specifically as far as the pigment and the resin can be milled favorably. Typically, the amount of use of the liquid medium is preferably 0.1 to 4 times and more preferably 0.5 to 3.6 times the total mass of the pigment and the resin.

The mean volume grain diameter of the pigment contained in the pigment dispersion is preferably 30 nm or larger and 200 nm or smaller, and more preferably 50 nm or larger and 130 nm or smaller in view of the color density, hue, stability, etc. of the ink. The mean volume grain diameter of the pigment can be adjusted by adjusting the grain diameter of the beads, the processing time, etc. in milling the pigment and the resin. Where the mean volume grain diameter is too small, the image density of a formed image may be lower than a desired value. By contrast, where the mean volume grain diameter is too large, clogging of the nozzles to eject the ink or ink ejection failure may be caused. The mean volume grain diameter of the pigment may be measured by, for example, a dynamic light scattering particle size analyzer (product by SYSMEX CORPORATION) or the like, using a sample obtained by diluting a pigment dispersion 300 times with ion exchanged water.

[Organic Solvent]

The ink used for the inkjet recording device according to the present disclosure contains an organic solvent for the purpose of acceleration of permeation of the ink into a recording medium and the like. Specific suitable examples of the organic solvent may include alkylene glycol monoalkyl ether, alkanediol having 6 to 9 carbon atoms, etc. The alkylene glycol monoalkyl ether may be, for example, ethylene glycol monobutyl ether, triethylene glycol monomethyl ether, triethylene glycol monobutyl ether, diethylene glycol monomethyl ether, ethylene glycol monomethyl ether, tripropylene glycol monomethyl ether, etc. The alkanediol having 6 to 9 carbon atoms may be, for example, 1,2-hexylene glycol, 1,2-octanediol, 2-ethyl-1,3-hexanediol, 2,4-diethyl-1,5-pentanediol, 2-ethyl-2-butyl-1,3-propanediol, etc. These organic solvents may be used solely or in combination of two or more.

Moreover, as the organic solvent, triethylene glycol monoalkyl ethers are preferable. Among them, triethylene glycol monobutyl ether is especially preferable. The content of triethylene glycol monobutyl ether in the ink is preferably 5.0 mass % or higher and 25.0 mass % or lower relative to the total mass of the ink. Setting the amount of triethylene glycol monobutyl ether contained in the ink within this range can set the solubility of the waste ink tray 61 to be 1.0 or higher and 3.0 or lower.

Where the amount of use of the organic solvent relative to the total mass of the ink is too small, the ink may not favorably permeate through a recording medium and hardly spread over the recording medium, thereby obtaining no image with desired density. By contrast, where the amount of use is too large, the ink may excessively permeate through a recording medium, thereby providing no image with desired density. Further, strike through may occur in a recording medium on which an image is formed.

[Moisturizing Agent]

The organic solvent contained in the ink according to the present disclosure may contain a moisturizing agent. The moisturizing agent can reduce volatilization of a liquid component from the ink to stabilize the viscosity of the ink. The ink viscosity can be adjusted by adjusting each amount of the moisturizing agent and water. Specific examples of the moisturizing agent may include polyethylene glycol, polypropylene glycol, ethylene glycol, propylene glycol, butylene glycol, diethylene glycol, dipropylene glycol, triethylene glycol, tripropylene glycol, 1,2,6-hexanetriol, thiodiglycol, 1,3-butanediol, 1,5-pentanediol, glycerin, etc. Among these moisturizing agents, glycerin is more preferable because of its excellent inhibitory effect to volatilization of liquid components, such as water. Two or more of the moisturizing agents may be used in combination. Where the ink contains the moisturizing agent, the content of the moisturizing agent is preferably 5 mass % or higher and 35 mass % or lower relative to the total mass of the ink.

Where the amount of use of the moisturizing agent relative to the total mass of the ink is too small, strike through may occur in a recording medium on which an image is formed. By contrast, where the amount of use of the moisturizing agent is too large, the ink may be hard to spread over a recording medium, thereby obtaining no image with desired density.

[Solution Stabilizer]

The organic solvent contained in the ink according to the present disclosure may contain a solution stabilizer. The solution stabilizer can compatibilize the components contained in the ink for stabilization of the dissolved state of the ink. Specific examples of the solution stabilizer may include 2-pyrrolidone, N-methyl-2-pyrrolidone, γ-butyrolactone, etc. Two or more of these solution stabilizers may be used in combination. Where the ink contains the solution stabilizer, the content of the solution stabilizer is preferably 1 mass % or higher and 20 mass % or lower, and more preferably 3 mass % or higher and 15 mass % or lower relative to the total mass of the ink.

[Method for Manufacturing Ink]

The ink manufacturing method is not limited specifically as far as the ink components, such as the pigment dispersion, water, the organic solvent, etc. can be mixed homogenously. One specific example of a method for manufacturing the ink for the inkjet recording device may be a method in which each component of the ink is mixed homogenously by a mixer, followed by removal of foreign matter and coarse particles through a filter with a pore diameter of 5 μm or smaller. It is noted that components of a solution stabilizer, a moisturizing agent, etc. and various additives, which are added to the ink for general inkjet recording devices, may be added as needed in manufacturing the ink. The additives may be, for example, a surfactant, an antioxidant, a viscosity modifier, a pH adjuster, an antiseptic, a fungicide, etc.

Any combination of the pigment dispersion, the organic solvent, and the like for the ink is not limited specifically within the scope not inhibiting the object of the present disclosure. For example, it is preferable to use a pigment dispersion containing styrene-acrylic resin as the resin, 1,3-butanediol, triethylene glycol monoalkyl ether, 2-pyrrolidone, and glycerin.

The content of the styrene-acrylic resin contained in the pigment dispersion is preferably 10 mass % or higher and 20 mass % or lower relative to the total mass of the pigment dispersion. The content of the pigment is preferably 15 mass % or higher and 25 mass % or lower relative to the total mass of the pigment dispersion. Further, the composition rates of the respective components of the ink may be preferably 20 mass % or higher and 30 mass % or lower of the pigment dispersion containing styrene-acrylic resin, 2.0 mass % or higher and 10.0 mass % or lower of 1,3-butanediol, 5.0 mass % or higher and 25.0 mass % or lower of the organic solvent, such as triethylene glycol monoalkyl ether or the like, 3.0 mass % or higher and 10.0 mass % or lower of 2-pyrrolidone, and 5 mass % or higher and 10 mass % or lower of glycerin relative to the total mass of the ink.

According to the inkjet recording device described above, the waste ink trays 61 can suppress a breeding of bacteria in the ink even retained for a long period of time. Also, degradation of the members by the ink can be reduced.

EXAMPLES

Manufacture Example 1

[Manufacture of Waste Ink Tray A]

A single-layer waste ink tray A made of an antibacterial agent containing resin composition was manufactured. For the antibacterial agent containing resin composition, acrylonitrile-butadiene-styrene copolymer (ABS) resin was used as the resin. As the antibacterial agent, α-[2-(4-chlorophenyl) ethyl]-α-(1,1-dimethylethyl)-1H-1,2,4-triazole-1-ethanol was used. Specifically, first, the aforementioned resin in a fused state was allowed to contain layered silicate supporting the antibacterial agent between its layers so that the amount of the antibacterial agent was 3 parts relative to the aforementioned resin of 100 parts to obtain an unmolded antibacterial agent containing resin composition. The unmolded antibacterial agent containing resin composition was extruded by a known extruder for extrusion molding to obtain the single layer waste ink tray A in a shape shown in FIG. 6 made of the antibacterial agent containing resin composition.

[Manufacture of Waste Ink Tray B]

A waste ink tray B was obtained by the same method as the waste ink tray A, except that the type of the antibacterial agent was changed to methyl-2-benzimidazole carbamate.

[Manufacture of Waste Ink Tray C]

A waste ink tray C was obtained by the same method as the waste ink tray A, except that the amount of the antibacterial agent was 5 parts relative to the resin of 100 parts.

[Manufacture of Waste Ink Tray D]

A waste ink tray D was obtained by the same method as the waste ink tray A, except that no antibacterial agent was used.

Manufacture Example 2

[Manufacture of Pigment Dispersion]

Ion exchanged water, pigment (phthalocyanine blue, P.B-15:3), styrene-acrylic resin, and glycerin were introduced into a nano grain mill (product by ASADA IRON WORKS. CO., LTD.) so that ion exchanged water, the pigment, styrene-acrylic resin, and glycerin were 55 mass %, 20 mass %, 15 mass %, and 10 mass %, respectively. Then, zirconium beads with a diameter of 0.5 mm were filled into the nano grain mill as a medium. Subsequently, the pigment was dispersed while being water-cooled in the nano grain mill, thereby obtaining a pigment dispersion. The obtained pigment dispersion was diluted 300 times with ion exchanged water. The mean volume grain diameter D50 of the pigment was measured by a dynamic light scattering particle size analyzer (Zetasizer Nano, product by SYSMEX CORPORATION). This confirmed that the mean volume grain diameter of the pigment was 100 nm.

Manufacture Example 3

[Manufacture of Ink a-g]

The pigment dispersion of 25 mass % obtained in Manufacture Example 2, Olfine E 1010 (surfactant, ethylene oxide adduct of acetylenediol, product by Nissin Chemical, Co., Ltd.) of 0.5 mass %, 1,3-butanediol of 5.0 mass %, triethylene glycol monobuthyl ether in the amounts listed in Table 1, 2-pyrrolidone (solution stabilizer) of 5.0 mass %, glycerin of 7.0 mass %, and ion exchanged water of the remaining mass parcentages were stirred and mixed homogenously by a stirrer (three-one motor, BL-600, a product by AS ONE Corporation) at a rotating speed of 400 rpm and were filtered with a filter with a pore diameter of 5 μm, thereby obtaining ink a-g.

TABLE 1

| | Ink | | | | | | |
|---|---|---|---|---|---|---|---|
| | a | b | c | d | e | f | g |
| Triethylene glycol monobuthyl ether (mass %) | 2.0 | 5.0 | 10.0 | 15.0 | 20.0 | 25.0 | 27.0 |

Examples

Evaluation was performed on Examples 1-7 and Comparative Examples 1-4 as combinations of types of waste ink tray and types of the ink listed in Table 2, that is, the waste ink trays A-D obtained by the manufacturing methods in Manufacture Example 1 and the ink a-g obtained by the manufacturing method in Manufacturing Example 3. Items on the evaluation are as follows.

TABLE 2

| | Type of waste ink tray | Type of ink |
|---|---|---|
| Example 1 | A | b |
| Example 2 | A | c |
| Example 3 | A | d |
| Example 4 | A | e |
| Example 5 | A | f |
| Example 6 | B | d |
| Example 7 | C | d |
| Comparative Example 1 | A | a |
| Comparative Example 2 | C | a |
| Comparative Example 3 | A | g |
| Comparative Example 4 | D | d |

According to the following measurement method, each solubility of the antibacterial agent containing resin compositions that form the corresponding waste ink trays in Examples 1-7 and Comparative Examples 1-4 was measured. Further, evaluation of antimicrobial property and strength against the ink were performed on each antibacterial agent containing resin composition used in Examples 1-7 and Comparative Examples 1-4. The measurement results of the solubility and the evaluation results of the antimicrobial property and the strength against ink of each antibacterial agent containing resin compositions in Examples 1-7 and Comparative Examples 1-4 are listed in Tables 3 and 4, respectively.

<Method for Measuring Solubility>

Each test piece of the antibacterial agent containing resin compositions (no antibacterial agent was contained in Comparative Example 4) was prepared. The test piece was square in shape with length and width of 1 cm and a thickness of 0.3 cm. The test piece was immersed in the corresponding ink of 10 g in a 25° C./50% RH environment. After m-month immersion, the mass $W_m$ of the test piece was measured, wherein m is 0.5, 1, 2, 6, or 12. From the mass $W_0$ of the test piece before immersion in the ink and the mass $W_1$ of the test piece after immersion, the mass reduction rate of each antibacterial agent containing resin composition was obtained by an equation (b). Further, from the mass $W_0$ of the test piece before immersion in the ink and the mass $W_{12}$ of the test piece after 12-month immersion, the solubility of each waste ink tray was obtained by an equation (c).

$$\text{Mass reduction rate}=(1-W_m/W_0)\times 100 \quad (b)$$

$$\text{Solubility}=(1-W_{12}/W_0)/12\times 100 \quad (c)$$

<Method for Evaluating Antimicrobial Property>

In order to evaluate the antimicrobial property of each waste ink tray after 0.5-1-, 2-, 6-, and 12-month elapse, each waste ink tray for evaluation was prepared for each elapsed period. The corresponding ink was introduced to the waste ink tray for evaluation. Subsequently, a predetermined amount of bacteria were added to the ink in the waste ink tray for evaluation after 0.5-, 1-, 2-, 6-, and 12-month elapse. The predetermined amount is an amount of bacteria when the number of bacteria on a culture medium (Food Plate X, product by Nissui Pharmaceutical Co., Ltd.) becomes $10^7$ by immersing the culture medium into ink in a waste ink tray in a 30° C./50% RH environment. The added bacteria ware colon *bacillus*, pseudomonad aeruginosa, *staphylococcus aureus*, candida (yeast), and *aspergillus niger*. They were used at equal proportion. The culture medium was immersed in the corresponding ink in each waste ink tray for evaluation after 0.5-, 1-, 2-, 6-, and 12-month elapse and was taken out from the ink in the waste ink tray after 0.5-, 1-, 2-, 6-, and 12-month elapse. In the valuation of the antimicrobial property, the case when no bacteria were observed on the culture medium is denoted by a circle. When bacteria were observed on the culture medium, the number of bacterial on the culture medium was counted as the number of bacteria contained in the ink.

<Evaluation of Strength Against Ink>

Each test piece of the antibacterial agent containing resin compositions (no antibacterial agent was contained in Comparative Example 4) was prepared. The test piece is rectangular in shape with a size of 1-cm short side, 2-cm long side, and 0.3-cm thickness. In a 25° C./50% RH environment, the ink of 0.2 g was dripped onto the surface of the test piece. Then, each state of the test pieces after 0.5-, 1-, 2-, 6-, and 12-month elapse was observed to check the presence or absence of breakage of the test piece. The case when breakage was observed in an elapsed period is denoted by a cross. It is noted that each comparative example, of which waste ink tray held ink with $10^7$ or more bacteria is indicated as $10^7$* in Table 4.

TABLE 3

| | | Elapsed month(s) | | | | | Solubility |
|---|---|---|---|---|---|---|---|
| | | 0.5 | 1 | 2 | 6 | 12 | (%/M) |
| Example 1 | Mass reduction rate | 0.5 | 1.1 | 1.9 | 5.9 | 12.0 | 1.0 |
| | Antimicrobial property | ○ | ○ | ○ | ○ | ○ | |
| | Strength against ink | ○ | ○ | ○ | ○ | ○ | |
| Example 2 | Mass reduction rate | 0.8 | 1.5 | 3.1 | 9.0 | 18.6 | 1.6 |
| | Antimicrobial property | ○ | ○ | ○ | ○ | ○ | |
| | Strength against ink | ○ | ○ | ○ | ○ | ○ | |
| Example 3 | Mass reduction rate | 0.9 | 2.0 | 3.9 | 11.9 | 24.5 | 2.0 |
| | Antimicrobial property | ○ | ○ | ○ | ○ | ○ | |
| | Strength against ink | ○ | ○ | ○ | ○ | ○ | |
| Example 4 | Mass reduction rate | 1.2 | 2.4 | 4.9 | 15.1 | 30.0 | 2.5 |
| | Antimicrobial property | ○ | ○ | ○ | ○ | ○ | |
| | Strength against ink | ○ | ○ | ○ | ○ | ○ | |
| Example 5 | Mass reduction rate | 1.5 | 3.1 | 6.0 | 18.2 | 34.6 | 3.0 |
| | Antimicrobial property | ○ | ○ | ○ | ○ | ○ | |
| | Strength against ink | ○ | ○ | ○ | ○ | ○ | |
| Example 6 | Mass reduction rate | 0.9 | 2.0 | 3.9 | 11.9 | 24.5 | 2.0 |
| | Antimicrobial property | ○ | ○ | ○ | ○ | ○ | |
| | Strength against ink | ○ | ○ | ○ | ○ | ○ | |

TABLE 3-continued

| | | Elapsed month(s) | | | | | Solubility |
|---|---|---|---|---|---|---|---|
| | | 0.5 | 1 | 2 | 6 | 12 | (%/M) |
| Example 7 | Mass reduction rate | 1.1 | 2.2 | 4.1 | 12.0 | 24.7 | 2.0 |
| | Antimicrobial property | ○ | ○ | ○ | ○ | ○ | |
| | Strength against ink | ◯ | ◯ | ◯ | ◯ | ◯ | |

TABLE 4

| | | Elapsed month(s) | | | | | Solubility |
|---|---|---|---|---|---|---|---|
| | | 0.5 | 1 | 2 | 6 | 12 | (%/M) |
| Comparative Example 1 | Mass reduction rate | 0.3 | 0.6 | 1.2 | 3.2 | 6.1 | 0.5 |
| | Antimicrobial property | ○ | ○ | $10^1$ | $10^2$ | $10^2$ | |
| | Strength against ink | ○ | ○ | ○ | ○ | ○ | |
| Comparative Example 2 | Mass reduction rate | 0.3 | 0.6 | 1.2 | 3.2 | 6.1 | 0.5 |
| | Antimicrobial property | ○ | ○ | ○ | ○ | $10^2$ | |
| | Strength against ink | ○ | ○ | ○ | ○ | ○ | |
| Comparative Example 3 | Mass reduction rate | 1.6 | 3.3 | 6.5 | 19.1 | 38.0 | 3.2 |
| | Antimicrobial property | ○ | ○ | ○ | ○ | ○ | |
| | Strength against ink | ○ | ○ | ○ | ○ | x | |
| Comparative Example 4 | Mass reduction rate | 0.9 | 2.0 | 3.9 | 11.9 | 24.5 | 2.0 |
| | Antimicrobial property | ○ | $10^3$ | $10^5$ | $10^7$* | $10^7$* | |
| | Strength against ink | ◯ | ◯ | ◯ | ◯ | ◯ | |

Tables 3 and 4 show that a breeding of the bacteria in the ink could be suppressed in the waste ink trays made of the antibacterial agent containing resin compositions, at least the surfaces of which had a solubility of 1.0 or higher and 3.0 or lower measured by the predetermined measurement method, even when the ink is retained for a long period of time. Also, degradation of the members by the ink could be reduced.

By contrast, it can be understood that in the waste ink tray in Comparative Example 1, in which the solubility of the antibacterial agent containing resin composition that forms the waste ink tray was too small, although degradation of the members could be reduced sufficiently, it was difficult to suppress a breeding of bacteria in the ink. Because, low dissolving speed of the resin in the antibacterial agent containing resin composition might have made it difficult to supply a sufficient amount of the antibacterial agent to the ink retained in the waste ink tray. Further, it can be understood that even in the waste ink tray in Comparative Example 2, in which the content of the antibacterial agent is larger than that of the antibacterial agent in Comparative Example 1, a breeding of the bacteria in the ink was difficult to be suppressed although degradation of the member by the ink could be sufficiently reduced.

Moreover, it is understood that in the waste ink tray in Comparative Example 3, in which the solubility of the antibacterial agent containing resin composition that forms the waste ink tray was too high, although the antibacterial agent, of which amount was sufficient to suppress a bacteria breeding, could be supplied, it was difficult to reduce degradation of the waste ink tray by the ink. Furthermore, it is understood that the waste ink tray in Comparative Example 4, which was made of resin containing no antibacterial agent, could not suppress a breeding of the bacteria in the ink.

The inkjet recording device 1 and the waste ink tray 61 according to the embodiments of the present disclosure have been described. However, the present disclosure is not limited to them and can be modified as follows, for example.

(1) The waste ink tray 61 described with reference to FIGS. 2-6 is not limited to the case where it is employed in an inkjet recording device. The waste ink tray 61 is employable in any other equipment that drains ink.

(2) An inkjet recording device according to one embodiment of the present disclosure may include a recording head and an ink tray. The recording head includes a nozzle. The nozzle ejects ink droplets. The ink tray receives the ink drained from the nozzle. The surface of the ink tray, which receives the ink, is made of an antibacterial agent containing resin composition. The solubility of the antibacterial agent containing resin composition, which is measured by a predetermined measurement method, is 1.0 or higher and 3.0 or lower.

An ink tray according to one embodiment of the present disclosure may be used in an inkjet recording device. The inkjet recording device includes a recording head. The recording head includes a nozzle. The nozzle ejects ink droplets. The ink tray receives the ink drained from the nozzle. The surface of the ink tray, which receives the ink, is made of an antibacterial agent containing resin composition. The solubility of the antibacterial agent containing resin composition, which is measured by a predetermined measurement method, is 1.0 or higher and 3.0 or lower.

According to the present disclosure, an inkjet recording device, an ink tray, and a waste ink collecting method using a ink tray can be provided by which a breeding of bacteria in the ink can be suppressed, and degradation of the members by ink can be reduced even in the case where the ink is retained for a long period of time.

What is claimed is:

1. An inkjet recording device, comprising:

a recording head configured to eject droplets of ink; and a waste ink tray configured to receive the ink drained from the recording head, wherein a surface of the waste ink tray, which receives the ink, is made of an antibacterial agent containing resin composition, and a solubility of the antibacterial agent containing resin composition, which is measured by a measurement method (X), is 1.0 or higher and 3.0 or lower, the measurement method (X) including:

preparing a test piece of the antibacterial agent containing resin composition, which is square in shape with length and width of 1 cm and a thickness of 0.3 cm;

immersing the test piece into water based ink with a weight of 10 g in a 25° C./50% RH environment;

measuring a mass $W_1$ of the test piece after one-month immersion; and obtaining the solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

2. The inkjet recording device of claim 1, wherein the antibacterial agent containing resin composition contains acrylonitrile-butadiene-styrene copolymer.

3. The inkjet recording device of claim 1, wherein
the waste ink tray is composed of an upper layer made of the antibacterial agent containing resin composition and a lower layer.

4. The inkjet recording device of claim 3, wherein
the lower layer is made of polycarbonate resin and/or polystyrene resin.

5. The inkjet recording device of claim 1, wherein
the antibacterial agent containing resin composition contains a triazole based antibacterial agent.

6. The inkjet recording device of claim 5, wherein
the triazole based antibacterial agent is α-[2-(4-chlorophenyl)ethyl]-α-(1,1-dimethylethyl)-1H-1,2,4-triazole-1-ethanol.

7. The inkjet recording device of claim 1, wherein
the antibacterial agent containing resin composition contains an antibacterial agent with a content of 1 part or more and 5 parts or less relative to resin of 100 parts contained in the antibacterial agent containing resin composition.

8. The inkjet recording device of claim 1, wherein
the solubility is adjusted by mixing two or more types of polymers as resin contained in the antibacterial agent containing resin composition.

9. The inkjet recording device of claim 1, of which recording method is of line head type.

10. A waste ink tray, comprising a surface configured to receive ink, wherein
the surface configured to receive the ink is made of an antibacterial agent containing resin composition, and
a solubility of the antibacterial agent containing resin composition, which is measured by a measurement method (X), is 1.0 or higher and 3.0 or lower, the measurement method (X) including:
preparing a test piece of the antibacterial agent containing resin composition, which is square in shape with length and width of 1 cm and a thickness of 0.3 cm;
immersing the test piece into water based ink with a weight of 10 g in a 25° C./50% RH environment;
measuring a mass $W_1$ of the test piece after one-month immersion; and
obtaining the solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

11. The waste ink tray of claim 10, wherein
the antibacterial agent containing resin composition contains acrylonitrile-butadiene-styrene copolymer.

12. The waste ink tray of claim 10, further comprising:
the waste ink tray is composed of an upper layer made of the antibacterial agent containing resin composition and a lower layer.

13. The waste ink tray of claim 12, wherein
the lower layer is made of polycarbonate resin and/or polystyrene resin.

14. The method of claim 12, wherein
the ink contains triethylene glycol monoalkyl ether of 5 mass % or higher and 25 mass % or lower relative to a total mass of the ink.

15. The waste ink tray of claim 10, wherein
the antibacterial agent containing resin composition contains a triazole based antibacterial agent.

16. The waste ink tray of claim 15, wherein
the triazole based antibacterial agent is α-[2-(4-chlorophenyl)ethyl]-α-(1,1-dimethylethyl)-1H-1,2,4-triazole-1-ethanol.

17. The waste ink tray of claim 10, wherein
the antibacterial agent containing resin composition contains an antibacterial agent with a content of 1 part or more and 5 parts or less relative to resin of 100 parts contained in the antibacterial agent containing resin composition.

18. The waste ink tray of claim 10, wherein
the solubility is adjusted by mixing two or more types of polymers as resin contained in the antibacterial agent containing resin composition.

19. A waste ink collecting method using a waste ink tray, comprising:
allowing the waste ink tray to receive ink,
wherein a surface of the waste ink tray, which receives the ink, is made of an antibacterial agent containing resin composition, and
a solubility of the antibacterial agent containing resin composition, which is measured by a measurement method (X), is 1.0 or higher and 3.0 or lower, the measurement method (X) including:
preparing a test piece of the antibacterial agent containing resin composition, which is square in shape with length and width of 1 cm and a thickness of 0.3 cm;
immersing the test piece into water based ink with a weight of 10 g in a 25° C./50% RH environment;
measuring a mass $W_1$ of the test piece after one-month immersion; and
obtaining the solubility of the antibacterial agent containing resin composition from a mass $W_0$ of the test piece before the immersion in the water based ink and the mass $W_1$ of the test piece after the immersion on the basis of an equation (a):

$$\text{solubility}=(1-W_1/W_0)\times 100 \quad \text{(a).}$$

* * * * *